US008054257B2

(12) United States Patent
Kwak et al.

(10) Patent No.: US 8,054,257 B2
(45) Date of Patent: Nov. 8, 2011

(54) ORGANIC LIGHT EMITTING DISPLAY AND DRIVING METHOD OF INSPECTION CIRCUIT OF ORGANIC LIGHT EMITTING DISPLAY

(75) Inventors: Won-Kyu Kwak, Yongin-si (KR); Jin-Tae Jeong, Yongin-si (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 816 days.

(21) Appl. No.: 11/783,711

(22) Filed: Apr. 11, 2007

(65) Prior Publication Data

US 2008/0036711 A1 Feb. 14, 2008

(30) Foreign Application Priority Data

Aug. 9, 2006 (KR) ..... 10-2006-0075175

(51) Int. Cl.
*G09G 3/32* (2006.01)

(52) U.S. Cl. ..... 345/82; 345/80; 345/204; 345/205; 345/904; 345/100; 345/76; 345/60; 324/527; 714/742

(58) Field of Classification Search ..... 345/82, 345/89, 76, 100, 98, 904, 50, 90, 117, 99, 345/365; 359/57, 59, 87, 88; 324/770, 158.1, 324/158 R, 678, 658, 537; 349/192; 714/724, 714/726, 729, 742, 743; 702/57–60, 117–118
See application file for complete search history.

(56) References Cited

U.S. PATENT DOCUMENTS 6,437,596 B1 8/2002 Jenkins et al.
7,027,551 B2 4/2006 Han et al.
7,443,373 B2 10/2008 Imagawa et al.
2002/0075248 A1 6/2002 Morita et al.
2004/0056828 A1* 3/2004 Choi et al. ..... 345/82
2004/0100428 A1 5/2004 Satoh
2004/0246757 A1* 12/2004 Miyagawa ..... 365/63

(Continued)

FOREIGN PATENT DOCUMENTS

CN 1576965 A 2/2005

(Continued)

OTHER PUBLICATIONS

Segura, et al.; CMOS electronics: how it works, how it fails; Wiley-IEEE; Apr. 1, 2004; pp. 137-139; United States.

(Continued)

*Primary Examiner* — Lun-Yi Lao
*Assistant Examiner* — Olga Merkoulova
(74) *Attorney, Agent, or Firm* — Lee & Morse, P.C.

(57) ABSTRACT

An OLED display and a driving method of an inspection circuit are provided. The OLED display may include a data driver, a scan driver, a driving transistor, a switching transistor, an organic light emitting diode, and an inspection circuit. The data driver and scan driver may apply a data signal and a scan signal. The driving transistor may generate a current corresponding to a voltage supplied to a first electrode and a control electrode. The switching transistor may apply the data signal to the driving transistor. The organic light emitting diode may be electrically connected to the driving transistor. The inspection circuit may include a three-phase inverter circuit having an input and an output terminal. The input terminal may supply a first power voltage to the output terminal when the output terminal decides an output signal regardless of a signal input to the input terminal.

20 Claims, 4 Drawing Sheets

U.S. PATENT DOCUMENTS

2005/0122297 A1* 6/2005 Imagawa et al. ..... 345/89

FOREIGN PATENT DOCUMENTS

| | | | |
|---|---|---|---|
| CN | 1584719 | A | 2/2005 |
| CN | 1 624 489 | A | 6/2005 |
| CN | 1804647 | A | 7/2006 |
| EP | 1635315 | A2 | 3/2006 |
| JP | 2001-306041 | | 11/2001 |
| KR | 10-2005-0011849 | | 1/2005 |
| KR | 10-2005-0017185 | | 2/2005 |
| KR | 10-2005-0108886 | | 11/2005 |
| KR | 10-2006-0017312 | | 2/2006 |

OTHER PUBLICATIONS

Dally, et al.; Digital Systems Engineering; 1998; pp. 588-590; University Press, Cambridge.

* cited by examiner

ORGANIC LIGHT EMITTING DISPLAY AND DRIVING METHOD OF INSPECTION CIRCUIT OF ORGANIC LIGHT EMITTING DISPLAY

BACKGROUND OF THE INVENTION

1. Field of the Invention

The present invention relates to an organic light emitting diode (OLED) display, an inspection circuit of an OLED display, and a driving method thereof.

2. Description of the Related Art

With the development of the electronics industry and the increase in the amount of information, there has been much research in active progress for developing a large screen display. Flat panel displays providing a large screen and low power consumption have been introduced to address these issues. Examples thereof include a liquid crystal display (LCD), a plasma display panel (PDP), and an organic light emitting diode (OLED) display. Particularly, OLED displays have been receiving attention as a flat panel display that can be made extremely thin, lightweight and having superior color reproducibility. An OLED display may have various additional advantages, e.g., a faster response speed than an LCD, superior luminance due to its self emission, a simple structure, and an easy manufacturing process. Therefore, the OLED display can be used for various products, e.g., a backlight, a portable terminal, a GPS system, a laptop computer, and a large screen TV.

Generally, in an OLED display, a first line extending in a first direction for receiving a scan signal and a light emission control signal may be disposed around an organic light emitting diode, a second line extending in a second direction for applying a data signal may be disposed to cross the first line, and a pixel may be disposed at an intersection between the first and second lines. Since such an OLED display may be manufactured through a plurality of manufacturing processes, the manufacturing cost thereof may increase and the reliability may be degraded according to defects caused during the manufacturing processes.

A conventional method of inspecting a sheet having a plurality of cells may generate a defect at a scan line as a result of interference between adjacent cells, and may induce malfunctions of turning on/off adjacent cells because of a voltage drop caused by leakage current. However, this method cannot measure the power consumption of a scan driver in a sheet unit before scribing.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention is therefore directed to an organic light emitting diode (OLED) display and a driving method of an inspection circuit of an OLED display, which substantially overcome one or more of the problems due to the limitations and disadvantages of the related art.

It is therefore a feature of an embodiment of the present invention to provide an OLED display and a driving method of an inspection circuit of an OLED display for reducing or preventing interference between cells.

It is therefore another feature of an embodiment of the present invention to provide an OLED display and a driving method of an inspection circuit of an OLED display for preventing or reducing a voltage drop generated during a sheet inspection.

It is therefore yet another feature of an embodiment of the present invention to provide an OLED display and a driving method of an inspection circuit of an OLED display for measuring the power consumption of a scan driver.

At least one of the above and other features and advantages of the present invention may be realized by providing an organic light emitting diode (OLED) display, including a data driver for applying a data signal, a scan driver for applying a scan signal, a driving transistor for generating a current corresponding to a voltage supplied from a first electrode and a control electrode, a switching transistor for applying the data signal to the driving transistor, an OLED electrically connected to the driving transistor, an inspection circuit including a three-phase inverter circuit having an input terminal and an output terminal, wherein the input terminal supplies a first power voltage to the output terminal when the output terminal determines an output signal regardless of a signal input to the input terminal.

The inspection circuit and the OLED may be on a same substrate. The three-phase inverter circuit may be formed at a predetermined area on the same substrate as the scan driver and the data driver except areas where the scan driver and the data driver are formed.

The three-phase inverter circuit may include a complementary semiconductor. The three-phase inverter may include a first transistor for supplying a first power voltage to a first electrode of the complementary semiconductor in response to a first signal input to a control electrode, and a second transistor for supplying the second power voltage to a second electrode of the complementary semiconductor in response to a second signal input to the control electrode.

The complementary semiconductor may include a third transistor for supplying the first power voltage to the output terminal in response to the first signal, and a fourth transistor for supplying the second power voltage to the output terminal in response to the second signal. The first and third transistors may be P channel transistors, and the second and fourth transistors may be N channel transistors.

The three-phase inverter circuit may include a first node where a first inverter sub-circuit and a second inverter sub-circuit are connected in series, and the first node may be an output terminal of the three-phase inverter circuit. The first inverter sub-circuit may include a p-type metal oxide semiconductor (PMOS), and the second inverter sub-circuit may include an n-type metal oxide semiconductor (NMOS).

The inspection circuit may include a two-phase inverter circuit, and an input terminal of the two-phase inverter circuit may be electrically connected to an output terminal of the three-phase inverter circuit.

The three-phase inverter circuit may output a signal to be inspected.

At least one of the above and other features and advantages of the present invention may be realized by providing a driving method of an inspection circuit in an organic light emitting diode (OLED) display including an OLED, a switching transistor, a scan driver, and an inspection circuit, where the OLED, the switching transistor, the scan driver, and the inspection circuit are formed on the same substrate, the driving method including supplying a first control signal, a second control signal, and an inspection signal from a sheet inspection signal generator to the inspection circuit, and supplying at least one signal corresponding to the inspection signal to the scan driver in response to the first control signal and the second control signal.

The scan driver may generate a scan signal for inspection using at least one signal, and may apply the sheet inspection scan signal to a control electrode of the switching transistor. The sheet inspection scan signal may be received in response to the first control signal and the second control signal, and the received scan signal may be reversed and output. The sheet inspection scan signal may be received when the first control signal and the second control signal are a high level and a low level, respectively, and the received scan signal may be reversed and output. The sheet inspection scan signal may be applied to the switching transistor when the first control signal and the second control signal are a high level and a low level. The sheet inspection scan signal may be blocked when the first control signal and the second control signal are a low level and a high level, respectively.

At least one of the above and other features and advantages of the present invention may be realized by providing a method of driving an inspection circuit of an organic light emitting diode (OLED) display including a power voltage line for sheet inspection for applying a power voltage for a sheet inspection circuit, an organic light emitting element, a driving transistor, a scan driver, and an inspection circuit, where the sheet inspection power voltage line, the organic light emitting element, the driving transistor, the scan driver, and the inspection circuit are formed at the same substrate, the method including supplying an inspection signal, a control signal, and an inverse control signal to the inspection circuit, generating at least one signal corresponding to the inspection signal in response to the control signal and the inverse-phase control signal, and supplying the generated signal to the scan driver, generating a scan signal using at least one signal, and applying the sheet inspection power voltage to the first electrode of the driving transistor in response to the scan signal.

The sheet inspection power voltage may be applied to the first electrode of the driving transistor when the control signal and the inverse-phase control signal are a high level and a low level, respectively. The sheet inspection power voltage may be blocked from the first electrode of the driving transistor when the control signal and the inverse-phase control signal are a low level and a high level, respectively.

The inspection method according to an exemplary embodiment of the present invention may inspect a cell unit without scribing. In order to perform a cell unit inspection in a sheet, a scan signal may be applied only to a target cell of the cell unit for inspection.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
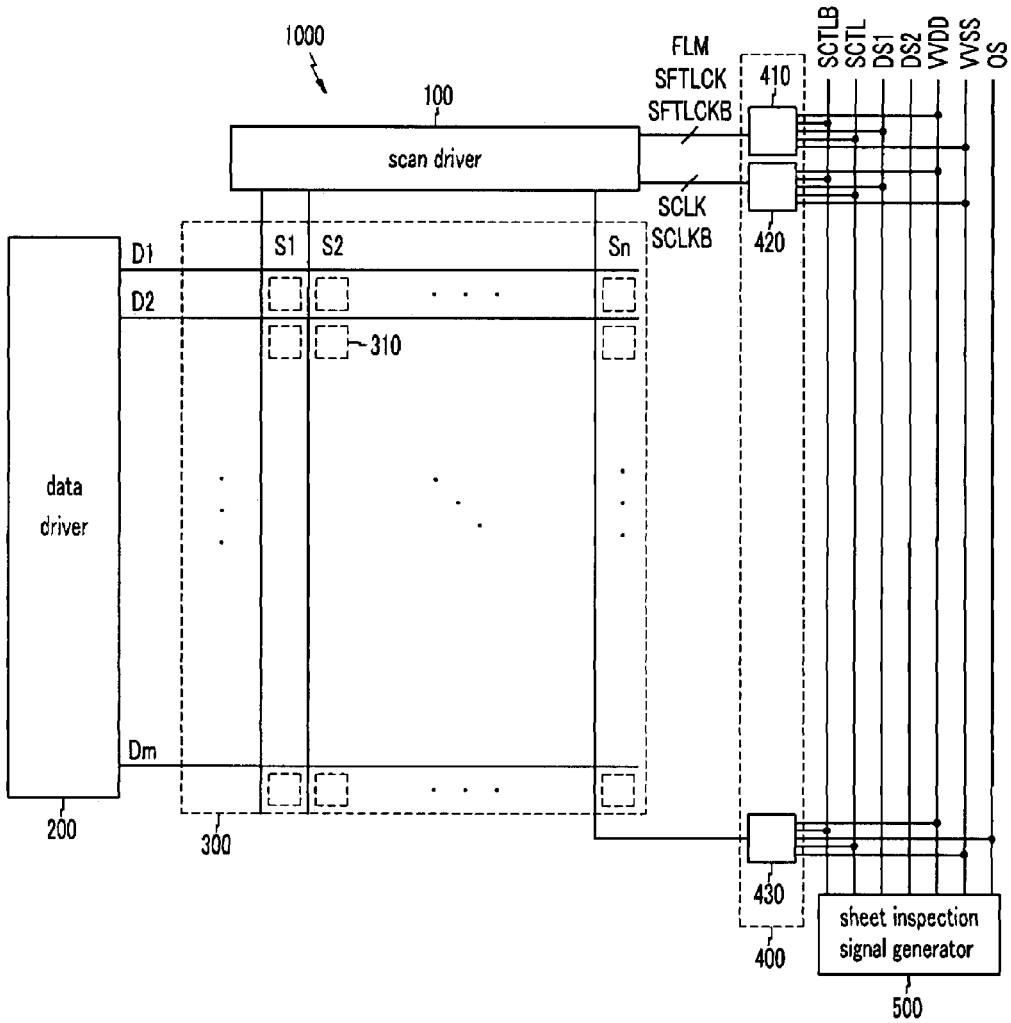
FIG. 1 illustrates a schematic plan view of an organic light emitting diode (OLED) display according to an exemplary embodiment of the present invention.

Korean Patent Application No. 10-2006-0075175 filed on Aug. 9, 2006, in the Korean Intellectual Property Office, and entitled: "Organic Light Emitting Display and Driving Method of Inspector Circuit of Organic Light Emitting Display," is incorporated by reference herein in its entirety.

As will be described in detail below, an organic light emitting diode (OLED) display and a method for driving an inspection circuit of the OLED display according to exemplary embodiments of the present invention are provided, which may reduce or prevent interference between cells and/or a voltage drop while inspecting a sheet including the OLED display.

In the following detailed description, only certain exemplary embodiments of the present invention have been shown and described, simply by way of illustration. As those skilled in the art would realize, the described embodiments may be modified in various different ways, all without departing from the spirit or scope of the present invention. In order to clearly describe the present invention, parts of the drawings unrelated to the description of the present invention have been omitted. Like reference numerals designate like elements throughout the specification.

When a first part is referred to as being "connected" to a second part, it could mean that the first part is directly connected to the second part, and it could also mean that the first part and the second part are "electrically connected" having a third element between them. Furthermore, when a part is referred to as "including" a constituent element, it does not mean that the part excludes other constituent elements, but it means that the part can further include other constituent elements, unless otherwise specified.

FIG. 1 illustrates a schematic plan view of a cell of an original circuit that is a subject of an inspecting method according to an exemplary embodiment of the present invention.

As shown in FIG. 1, a cell 1000 of an original circuit may include a scan driver 100, a data driver 200, a display unit 300, and an inspection circuit 400 of an OLED display. The cell 1000 may be connected to a first power supply line supplying a power voltage VVDD, a second power supply line supplying a power voltage VVSS, first and second inspection signal supply lines that supply first and second inspection signals DS1 and DS2, a scan signal supply line that supplies an output signal OS corresponding to a scan signal scan[n], and a first control signal line SCTL and a second control signal line SCTLB that supplies a first control signal and a second control signal, respectively.

The scan driver 100 may receive a frame pulse FLM, a first shiftclock signal SFTCLK, a second shiftclock signal SFTCLKB, a first clock signal SCLK1, and a second clock signal SCLK2, and may generate a scan signal to be supplied to a respective scan line S1-Sn.

The data driver 200 may generate a data signal corresponding to an externally input image input signal, and may supply the data signal to a respective data line D1-Dm.

The display unit 300 may include a plurality of pixel circuits 310. Each pixel circuit 310 may include an organic light emitting element, a switch, a capacitor, and a driving transistor. Each pixel circuit 310 may be disposed at a region where the scans line S1-Sn and the data lines D1-Dm intersect each other. Each pixel circuit 310 may be connected to respective ones of the scan lines S1-Sn and the data lines D1-Dm, and a current corresponding to the data signal input in response to a scan signal may be generated. This current may be supplied to the organic light emitting element, and the organic light emitting element may emit light in response to the current.

The inspection circuit 400 may receive the first control signal SCTL, the second control signal SCTLB, and the first and the second inspection signals DS1 and DS2, and may generate the frame pulse FLM, the first shiftclock signal SFTCLK, the second shiftclock signal SFTCLKB, the first clock signal SCLK1, and the second clock signal SCLK2 to be output to the scan driver 100. The first control signal SCTL and the second control signal SCTLB may be signals having inverse phases with respect to each other.

The inspection circuit 400 may include a first signal input section 410, a second signal input section 420, and a signal receiving unit 430. The first signal input section 410 may generate the frame pulse FLM, the first shiftclock signal SFTCLK, and the second shiftclock signal SFTCLKB, and may output them to the scan driver 100. The second signal input section 420 may generate the first clock signal SCLK1 and the second clock signal SCLK2, and may output them to the scan driver 100. The signal receiving unit 430 may receive the scan signal output from at least one of the scan lines S1-Sn of the display unit 300, and may generate and output the output signal OS corresponding to the received scan signal scan[n]. A scan waveform may be measured using the signal output from the signal receiving unit 430, and a power consumption level of the scan driver 100 may be measured.

Although the inspection circuit 400 illustrates only the first signal input section and the second signal input section in FIG. 1 consistent with the exemplary embodiment of the present invention, the frame pulse FLM, the first shiftclock signal SFTCLK, the second shiftclock signal SFTCLKB, the first clock signal SCLK1, and the second clock signal SCLK2 may be generated in a separate signal input section. However, since the frame pulse FLM, the first shiftclock signal SFTCLK, and the second shiftclock signal SFTCLKB may be generated in the first signal input section 410 having substantially the same structure, only one first signal input section 410 is illustrated for better understanding and ease of description. Furthermore, since the first clock signal SCLK1 and the second clock signal SCLK2 may be generated in the second signal input section having substantially the same structure, only one second signal input section 420 is illustrated for better understanding and ease of description.

As shown in FIG. 1, a sheet inspection signal generator 500 may generate the first and second inspection signals DS1 and DS2, the first power voltage VVDD, the second power voltage VVSS, and the first and second control signals SCTL and SCTLB, and may supply the same to a sheet including the cell 1000. Then, the sheet inspection signal generator 500 may receive the signal OS output from the cell 1000 that is subjected to the inspection. The power consumption level of the scan driver 100 may be measured according to the received signal. FIG. 1 illustrates that the signal receiving unit 430 receives the scan signal output from the scan line Sn. However, the present invention is not limited to this. The signal receiving unit 430 may receive two or more scan signals to measure waveforms of each scan signal, and the power consumption level of the scan driver 100 may be measured according to the measured waveforms of the scan signals.

Figure 2:
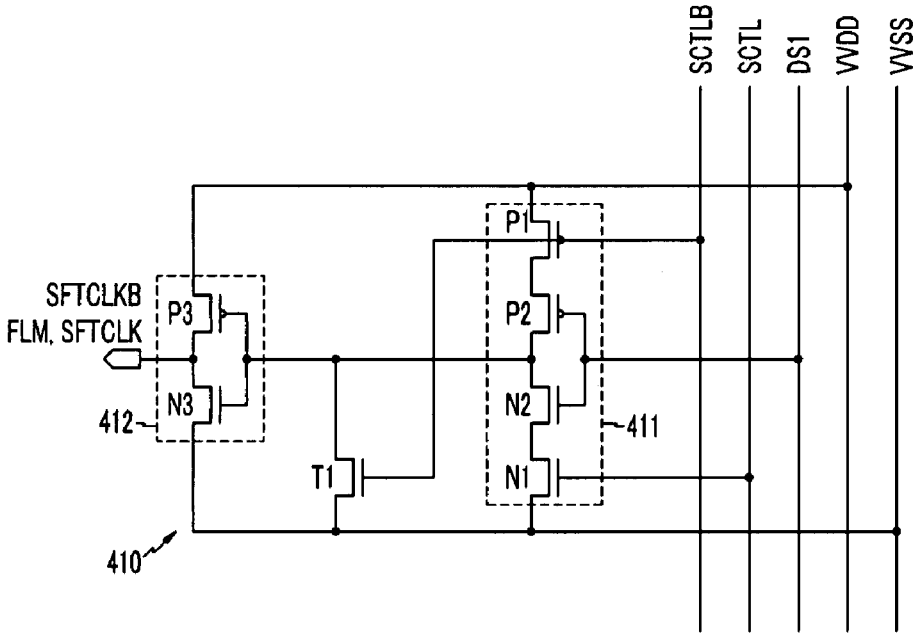
FIG. 2 illustrates a schematic diagram of a first signal input section according to an exemplary embodiment of the present invention.

FIG. 2 illustrates a schematic diagram of the first signal input section 410 according to an exemplary embodiment of the present invention.

The first signal input section 410 consistent with the exemplary embodiment of the present invention may generate the frame pulse FLM, the first shiftclock signal SFTCLK, and the second shiftclock signal SFTCLKB, in accordance with the first power voltage VVDD and/or the second power voltage VVSS.

As shown in FIG. 2, the first signal input section may include a three-phase inverter 411, a first inverter 412, and a first transistor T1. Hereinafter, a transistor consistent with the exemplary embodiment of the present invention may include a source electrode, a drain electrode, and a gate electrode as a first electrode, a second electrode, and a control electrode, respectively. Furthermore, a complementary metal oxide semiconductor (CMOS) may be used as a complementary semiconductor.

The three-phase inverter 411 may include two PMOS transistors P1 and P2, and two NMOS transistors N1 and N2. The two PMOS transistors P1 and P2 may form a first inverter sub-circuit unit of the three-phase inverter, and the two NMOS transistor N1 and N2 may form a second inverter sub-circuit unit of the three-phase inverter. Furthermore, the PMOS transistor P2 and the NMOS transistor N2 may form one CMOS inverter. A node where the first inverter sub-circuit unit and the second inverter sub-circuit unit meet may serve as an output terminal of the three-phase inverter 411.

The second control signal SCTLB may be supplied to a gate electrode of the PMOS transistor P1, and the first control signal SCTL may be supplied to a gate electrode of the NMOS transistor N1. At this time, if the first and second control signals SCTL and SCTLB have a high level and a low level, respectively, the PMOS transistor P1 and the NMOS transistor N1 may be turned on. Thus, an output may be determined according to the first inspection signal DS1, which may be supplied to gate electrodes of the PMOS transistor P2 and the NMOS transistor N2. If the first inspection signal DS1 has a high level, then the NMOS transistor N2 may be turned on. At this time, if the first control signal SCTL has a high level, the voltage of the second power supply VVSS may be output to an output terminal of the three-phase inverter. If the first inspection signal DS1 has a low level, then the PMOS transistor P2 may be turned on. At this time, if the second control signal SCTLB has a low level, the first power voltage VVDD may be output to an output terminal of the three-phase inverter.

The second control signal SCTLB may be supplied to a gate electrode of the first transistor T1. A drain electrode of the first transistor T1 may be connected to the output terminal of the three-phase inverter 411, and a source electrode of the first transistor T1 may be connected to the second power voltage VVSS. An input terminal of the first inverter 412 may be connected to the output terminal of the three-phase inverter 411 and the drain electrode of the first transistor T1.

An output terminal of the first inverter 412 may be connected to the scan driver 100. The first transistor T1 may be turned on when an output of the three-phase inverter 411 is determined by the first and second control signals SCTL and SCTLB regardless of the input signal, and may supply the voltage of the second power voltage VVSS to the first inverter 412. If the first and second control signals SCTL and SCTLB have a low level and a high level, respectively, then the PMOS transistor P1 and the NMOS transistor N1 may both be turned off. Thus, an output may be determined regardless of the input signal. At this time, the first transistor T1 may be turned on, and may supply the second power voltage VVSS to the input terminal of the first inverter 412.

The first inverter 412 may include a CMOS transistor having a PMOS transistor P3 and an NMOS transistor N3. If an input voltage is the first power voltage VVDD, then the voltage of the second power supply VVSS may be output. If the input voltage is the second power voltage VVSS, then the first power voltage VVDD may be output. Consistent with the exemplary embodiment of the present invention, the first power voltage VVDD may be a voltage of a high level, and the second power voltage VVSS may be a voltage of a low level.

Figure 3:
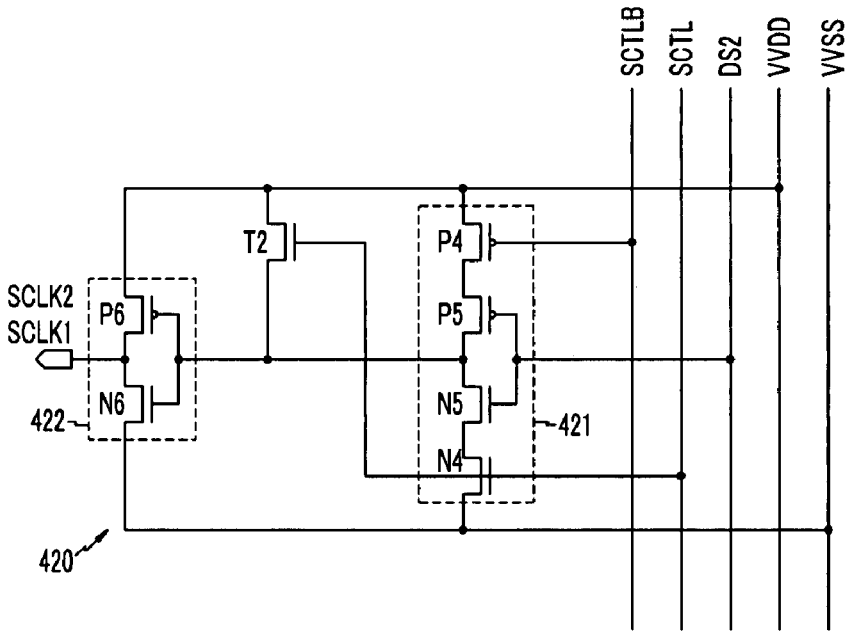
FIG. 3 illustrates a schematic diagram of a second signal input section according to an exemplary embodiment of the present invention.

FIG. 3 illustrates a schematic diagram of the second signal input section 420 according to an exemplary embodiment of the present invention.

The second signal input section 420 may generate the first clock signal SCLK1 and the second clock signal SCLK2, and may receive the first power voltage VVDD or the second power voltage VVSS.

As shown in FIG. 3, the second signal input section may include a three-phase inverter 421, a second inverter 422, and a second transistor T2.

The three-phase inverter 421 may include two PMOS transistors P4 and P5, and two NMOS transistors N4 and N5. The two PMOS transistors P4 and P5 may form a third inverter sub-circuit unit of the three-phase inverter 421, and the two NMOS transistors N4 and N5 may form a fourth inverter sub-circuit unit of the three-phase inverter 421. The PMOS transistor P5 and the NMOS transistor N5 may form one CMOS inverter. A node where the third inverter sub-circuit unit and the fourth inverter sub-circuit unit meet may serve as an output terminal of the three-phase inverter 421.

The second control signal SCTLB may be supplied to a gate electrode of the PMOS transistor P4, and the first control signal SCTL may be supplied to a gate electrode of the NMOS transistor N4. At this time, if the first and second control signals SCTL and SCTLB have a high level and a low level, respectively, the PMOS transistor P4 and the NMOS transistor N4 may be turned on. Thus, an output may be determined according to the second inspection signal DS2. If the second inspection signal DS2 has a high level, then the NMOS transistor N5 may be turned on. At this time, if the first control signal SCTL has a high level, the voltage of the second power supply VVSS may be output to an output terminal of the three-phase inverter 421. If the second inspection signal DS2 has a low level, then the PMOS transistor P5 may be turned on. At this time, if the second control signal SCTLB has a low level, the voltage of the first power supply VVDD may be output to an output terminal of the three-phase inverter 421.

The first control signal SCTL may be supplied to a gate electrode of the second transistor T2. A drain electrode of the second transistor T2 may be connected to the output terminal of the three-phase inverter 421, and a source electrode of the second transistor T2 may be connected to the first power supply VVDD.

An input terminal of the second inverter 422 may be connected to the output terminal of the three-phase inverter 421 and the drain of the second transistor T2. An output terminal of the second inverter 422 may be connected to the scan driver 100. The second transistor T2 may be turned on when an output of the three-phase inverter 421 is determined by the first and second control signals SCTL and SCTLB regardless of the input signal, and may supply the voltage of the first power supply VVDD to the second inverter 422. If the first and second control signals SCTL and SCTLB are a low level and a high level, respectively, then the PMOS transistor P4 and the NMOS transistor N4 may both be turned off. Thus, an output may be determined regardless of the input signal. At this time, the second transistor T2 may be turned on and may supply the first power voltage VVDD to the second inverter 422.

If an input voltage input to the input terminal of the second inverter 422 is the first power voltage VVDD, then the second inverter 422 may output the second power voltage VVSS. If the input voltage input to the input terminal of the second inverter 422 is the second power voltage VVSS, then the second inverter 422 may output the first power voltage VVDD. Consistent with the exemplary embodiment of the present invention, the first power voltage VVDD may be a voltage of a high level, and the second power voltage VVSS may be a voltage of a low level.

Figure 4:
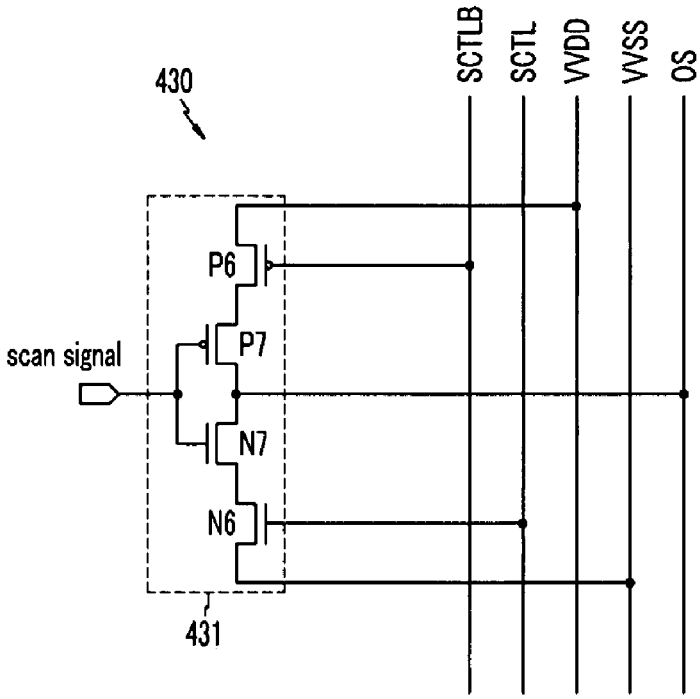
FIG. 4 illustrates a schematic diagram of a signal receiving unit according to an exemplary embodiment of the present invention.

FIG. 4 illustrates a schematic diagram of a signal receiving unit 430 according to an exemplary embodiment of the present invention.

The signal receiving unit 430 may have an input terminal connected to at least one of the scan lines S1-Sn, and may receive a respective scan signal scan[n] applied to the scan line S1-Sn, generate the signal OS corresponding to the scan signal scan[n], and output the generated signal OS. The signal receiving unit 430 according to the present embodiment may include a three-phase inverter 431.

The three-phase inverter 431 may include two PMOS transistors P6 and P7, and two NMOS transistors N6 and N7. The two PMOS transistors P6 and P7 may form a fifth inverter sub-circuit unit of the three-phase inverter 431, and the two NMOS transistors N6 and N7 may form a sixth inverter sub-circuit unit of the three-phase inverter 431. The PMOS transistor P7 and the NMOS transistor N7 may form one CMOS inverter. A node where the fifth inverter sub-circuit unit and the sixth inverter sub-circuit unit meet may serve as an output terminal.

As shown in FIG. 4, the three-phase inverter 431 may output a first power voltage VVDD or a second power voltage VVSS corresponding to a scan signal scan[n] when the first control signal SCTL and the second control signal SCTLB are a high level and a low level, respectively. The scan signal scan[n] may be supplied to gate electrodes of the PMOS transistor P7 and the NMOS transistor N7.

If the scan signal scan[n] has a low level, the PMOS transistor P7 may be turned on. If the second control signal SCTLB has a low level when the PMOS transistor P7 is turned on, the first power voltage VVDD may be supplied to the output node. Then, the signal OS output from the signal receiving unit 430 may become the first power voltage VVDD, and may be supplied to the inspection power voltage generator 500. At this time, based on the result, a low level scan signal may be applied, and it may be determined that the OLED display operates normally.

On the other hand, if the scan signal is a high level and the first control signal SCTL is a high level, NMOS transistors N6 and N7 may be turned on, and the signal OS output from the signal receiving unit 430 may become the second power voltage VVSS, and may be output to the inspection signal generator 500. Then, a high level scan signal may be applied, and it can be determined that the scan signal is output from the scan driver 100 normally.

A waveform of a scan signal may be estimated by measuring a signal waveform output from the signal receiving unit 430, and the power consumption of a scan driver may be measured using the estimated waveform.

According to the exemplary embodiment of the present invention, an OLED display having a target cell for inspection operates normally in a sheet.

When the OLED display of other cells except the target cell do not operate normally, a pixel circuit of each OLED display does not bias in the sheet. Accordingly, a black image may be displayed. In order for an OLED display to not operate normally, signals input to the scan driver, e.g., the frame pulse FLM, the first shiftclock signal SFTCLK, the second shiftclock signal SFTCLKB, the first clock signal CLK1, and the second clock signal SCLK2, may satisfy following conditions. The frame pulse FLM, the first shiftclock signal SFTCLK, and the second shiftclock signal may be the first power voltage VVDD, and the first clock signal CLK1 and the second clock signal SCLK2 may be the second power voltage VVSS.

The inspection circuit 400 may generate the frame pulse FLM, the first shiftclock signal SFTCLK, the second shiftclock signal SFTCLKB, the first clock signal CLK1, and the second clock signal SCLK2 according to an inspection signal DS if the first control signal SCTL and the second control signal SCTLB are a high level and a low level, respectively. Then, the inspection circuit 400 may output the generated signals to the scan driver 100.

On the contrary, if the first control signal SCTL and the second control signal SCTLB are a low level and a high level, respectively, the inspection circuit 400 may generate the frame pulse FLM, the first shiftclock signal SFTCLK, and the second shiftclock signal SFTCLKB as the first power voltage VVDD, and may generate the first clock signal CLK1 and the second clock signal SCLK2 as the second power voltage VVDD, regardless of the inspection signal DS. Then, the inspection circuit 400 may output the generated signal to the scan driver 100.

As described above, the OLED display according to an exemplary embodiment of the present invention may inspect desired cells from an original circuit unit without scribing.

Also, if each cell 1000 is cut off from the sheet, the inspection circuit 400 may remain at each cell 1000. That is, the inspection circuit 400 according to an exemplary embodiment of the present invention may be placed at a trimming margin where the cell 1000 is trimmed from the sheet. After cutting off the cell 1000, the inspection circuit 400 may remain at a substrate where the OLED display is formed. However, the scan driver 100 and the data driver 200 may be connected to a signal controller (not shown) when the OLED display is completely manufactured after inspection. The signal controller may receive a vertical synchronization signal, a horizontal synchronization signal, a clock signal, and external image data, may generate a scan signal and a data signal, and may output them to a scan driver and a data driver.

Hereinafter, in a cell 1000 having an OLED display according to an exemplary embodiment of the present invention that is a target for inspection, the operation of a pixel circuit will be described with reference to FIG. 5 and FIG. 6.

Figure 5:
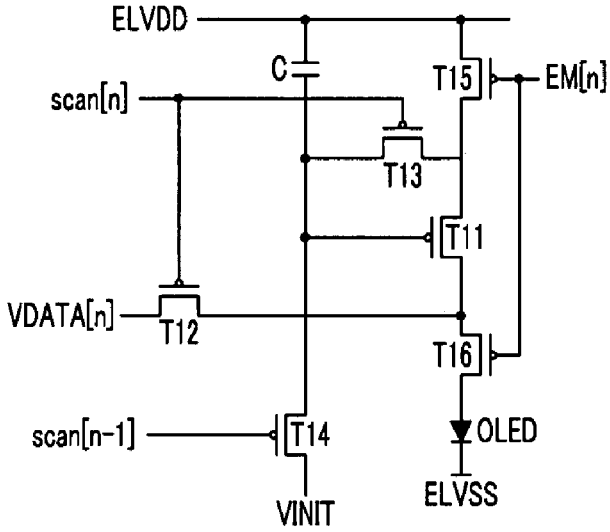
FIG. 5 illustrates a schematic diagram of a pixel circuit according to an exemplary embodiment of the present invention.

FIG. 5 illustrates a schematic diagram of a pixel circuit according to an exemplary embodiment of the present invention. FIG. 6 illustrates timing diagrams of a previous scan signal for inspection, a current scan signal, and a light emission control signal according to an exemplary embodiment of the present invention.

As shown in FIG. 5, the pixel circuit may include first to sixth transistors T11 to T16, an organic light emitting diode (OLED) element, and a capacitor C. In the pixel circuit according to an exemplary embodiment of the present invention, the scan driver 100 generates a light emission control signal EM[n].

The second transistor T12 may be turned on in response to the current scan signal scan[n], and if the second transistor T12 is turned on, a data voltage VDATA may be output to a first electrode of the first transistor T11. The first transistor T11 may be a driving transistor, and a gate electrode of the first transistor T11 may be connected to one end of the capacitor C. A source electrode of the first transistor T11 may be connected to a drain electrode of the third transistor T13. The third transistor T13 may be turned on in response to the scan signal scan[n]. After being turned on, the third transistor T13 may diode-connect the first transistor T11. The fourth transistor T14 may be turned on in response to the previous scan signal scan[n−1]. After being turned on, an initial voltage VINIT may be applied to one end of the capacitor C through the fourth transistor T14. The fifth transistor T15 and the sixth transistor T16 may be turned on in response to a light emission control signal EM[n]. After being turned on, the power voltage ELVDD may be supplied to the second electrode of the first transistor T11 through the fifth transistor T15. If the sixth transistor T16 is turned on, the drain current of the first transistor T11 may be supplied to the OLED. The OLED may emit light corresponding to the drain current of the first transistor T11.

Figure 6:
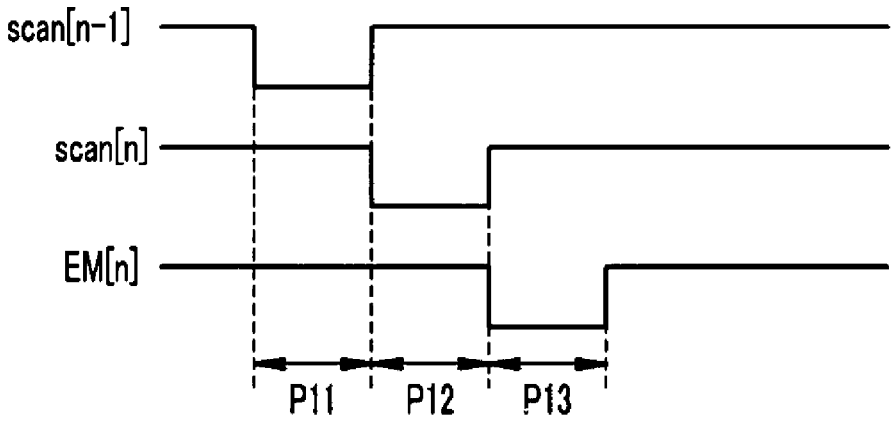
FIG. 6 illustrates a timing diagram of a previous scan signal for inspection, a current scan signal, and a light emission control signal according to an exemplary embodiment of the present invention.

As can be seen in FIG. 6, at first, during a period P11, the previous scan signal scan[n−1] has a low level. Thus, the fourth transistor T14 may be turned on, thereby supplying an initial voltage to one end of the capacitor C. During a period P12, the current scan signal S[n] has a low level. Thus, the third transistor T13 may be turned on, thereby diode-connecting the first transistor T11 and supplying a data voltage VDATA[n] to the second electrode of the first transistor T11 through the second transistor T12. Then, the voltage at the gate electrode of the first transistor T11, the first electrode, and one end of the capacitor C becomes a voltage VDATA+VTH.

During a period P13, the light emission control signal EM[n] has a low level, thereby turning on the fifth transistor T15 and the sixth transistor T16. If the power voltage ELVDD is supplied to the first electrode of the first transistor T11, a current may be generated corresponding to the voltage difference VGS of the first electrode and the gate electrode of the first transistor T11 as in Equation 1. The voltage of the gate may be VDATA+VTH, and the first electrode may become a source electrode. Therefore, a voltage VGS may become a voltage VDATA+VTH−ELVDD. A voltage VDATA is a data voltage VDATA[n], and a voltage VTH is a threshold voltage of the first transistor T11. Then, a current may be generated as in Equation 2. That is, a current is generated corresponding to a voltage compensated with the threshold voltage of the first transistor T11. Also, the power voltage ELVDD according to the present embodiment may be the first power voltage VVDD or a voltage corresponding to the first power voltage VVDD.

$$I_{OLED} = \frac{\beta}{2}(VGS - VTH)^2 \tag{1}$$

$$I_{OLED} = \frac{\beta}{2}(ELVDD - VDATA)^2 \tag{2}$$

In Equations 1 and 2, β is a constant that is determined depending on the characteristics of the first transistor T11.

As described above, the OLED display of a target cell for inspection in a sheet may generate a current corresponding to the data voltage so that the organic light emitting element emits light, and the OLED display of a non-target cell for inspection does not emit light. Therefore, interference between adjacent cells may be prevented, and the voltage drop may be prevented because the power voltage ELVDD is not supplied to the driving transistor of the non-selected cell.

Exemplary embodiments of the present invention have been disclosed herein, and although specific terms are employed, they are used and are to be interpreted in a generic and descriptive sense only and not for purpose of limitation.

Accordingly, it will be understood by those of ordinary skill in the art that various changes in form and details may be made without departing from the spirit and scope of the present invention as set forth in the following claims.

What is claimed is:

1. An organic light emitting diode (OLED) display, comprising:

a data driver for applying a data signal;

a scan driver for applying a scan signal;

a driving transistor for generating a current corresponding to a voltage supplied from a first electrode and a control electrode;

a switching transistor for applying the data signal to the driving transistor;

an OLED electrically connected to the driving transistor; and an inspection circuit, separate from the data driver and the scan driver, the inspection circuit including a transistor and a three-phase inverter circuit having an input terminal and an output terminal, wherein the transistor supplies a first power voltage to the output terminal when the output terminal determines an output signal regardless of a signal input to the input terminal.

2. The OLED display as claimed in claim 1, wherein the inspection circuit and the OLED are on a same substrate.

3. The OLED display as claimed in claim 2, wherein the three-phase inverter circuit is formed at a predetermined area on the same substrate as the scan driver and the data driver except areas where the scan driver and the data driver are formed.

4. The OLED display as claimed in claim 1, wherein the three-phase inverter circuit comprises a complementary semiconductor.

5. The OLED display as claimed in claim 4, wherein the three-phase inverter further comprises:

a first transistor for supplying a first power voltage to a first electrode of the complementary semiconductor in response to a first signal input to a control electrode; and a second transistor for supplying the second power voltage to a second electrode of the complementary semiconductor in response to a second signal input to the control electrode.

6. The OLED display as claimed in claim 5, wherein the complementary semiconductor comprises:

a third transistor for supplying the first power voltage to the output terminal in response to the first signal; and a fourth transistor for supplying the second power voltage to the output terminal in response to the second signal.

7. The OLED display as claimed in claim 6, wherein the first and third transistors are P channel transistors, and the second and fourth transistors are N channel transistors.

8. The OLED display as claimed in claim 1, wherein the three-phase inverter circuit comprises a first node where a first inverter sub-circuit and a second inverter sub-circuit are connected in series, and the first node is an output terminal of the three-phase inverter circuit.

9. The OLED display as claimed in claim 8, wherein the first inverter sub-circuit includes a p-type metal oxide semiconductor (PMOS), and the second inverter sub-circuit includes an n-type metal oxide semiconductor (NMOS).

10. The OLED display as claimed in claim 1, wherein the inspection circuit further comprises a two-phase inverter circuit, and an input terminal of the two-phase inverter circuit is electrically connected to an output terminal of the three-phase inverter circuit.

11. The OLED display as claimed in claim 1, wherein the three-phase inverter circuit outputs a signal to be inspected.

12. A driving method of an inspection circuit in an organic light emitting diode (OLED) display including an OLED, a switching transistor, a scan driver, and an inspection circuit, the inspection circuit being separate from the scan driver, where the OLED, the switching transistor, the scan driver, and the inspection circuit including a transistor and a three-phase inverter circuit are formed on a same substrate, the driving method comprising:

supplying a first control signal, a second control signal, and an inspection signal from a sheet inspection signal generator to the three-phase inverter circuit;

supplying at least one signal corresponding to the inspection signal to the scan driver in response to the first control signal and the second control signal; and supplying a first power voltage to the scan driver through the transistor when the inspection circuit determines the at least one signal regardless of the inspection signal input to the three-phase inverter circuit.

13. The method as claimed in claim 12, further comprising at the scan driver, generating a scan signal for inspection using at least one signal, and applying the sheet inspection scan signal to a control electrode of the switching transistor.

14. The method as claimed in claim 13, further comprising receiving the sheet inspection scan signal in response to the first control signal and the second control signal, reversing the received scan signal, and outputting the reversed scan signal.

15. The method as claimed in claim 14, wherein the sheet inspection scan signal is received when the first control signal and the second control signal are a high level and a low level, respectively, and the received scan signal is reversed and output.

16. The method as claimed in claim 13, further comprising applying the sheet inspection scan signal the switching transistor when the first control signal and the second control signal are a high level and a low level.

17. The method as claimed in claim 13, further comprising blocking the sheet inspection scan signal when the first control signal and the second control signal are a low level and a high level, respectively.

18. A method of driving an inspection circuit of an organic light emitting diode (OLED) display including a power voltage line for sheet inspection for applying a power voltage for a sheet inspection circuit including a transistor and a three-phase inverter circuit, an organic light emitting element, a driving transistor, a scan driver, and an inspection circuit, where the sheet inspection power voltage line, the organic light emitting element, the driving transistor, the scan driver, and the inspection circuit are formed on a same substrate, the method comprising:

supplying an inspection signal, a control signal, and an inverse control signal to the inspection circuit;

generating at least one signal corresponding to the inspection signal in response to the control signal and the inverse-phase control signal, and supplying the generated signal to the scan driver;

supplying the power voltage to the scan driver through the transistor when the inspection circuit determines the at least one signal regardless of the inspection signal input to the three-phase inverter circuit;

generating a scan signal using at least one signal; and applying the sheet inspection power voltage to the first electrode of the driving transistor in response to the scan signal.

19. The method as claimed in claim 18, further comprising applying the sheet inspection power voltage to the first electrode of the driving transistor when the control signal and the inverse-phase control signal are a high level and a low level, respectively.

20. The method as claimed in claim 18, further comprising blocking the sheet inspection power voltage from the first electrode of the driving transistor when the control signal and the inverse-phase control signal are a low level and a high level, respectively.

* * * * *